US010849381B2

(12) United States Patent
Moorefield-Shraibman

(10) Patent No.: US 10,849,381 B2
(45) Date of Patent: Dec. 1, 2020

(54) REMOVABLE BUTTON WITH MAGNETIC DISC INSERT ASSEMBLY

(71) Applicant: Adrienne Teresa Moorefield-Shraibman, Baltimore, MD (US)

(72) Inventor: Adrienne Teresa Moorefield-Shraibman, Baltimore, MD (US)

( * ) Notice: Subject to any disclaimer, the term of this patent is extended or adjusted under 35 U.S.C. 154(b) by 101 days.

(21) Appl. No.: 16/350,825

(22) Filed: Jan. 18, 2019

(65) Prior Publication Data

US 2019/0246725 A1 Aug. 15, 2019

Related U.S. Application Data

(60) Provisional application No. 62/710,249, filed on Feb. 15, 2018.

(51) Int. Cl.
*A41F 1/00* (2006.01)

(52) U.S. Cl.
CPC ..... *A41F 1/002* (2013.01)

(58) Field of Classification Search
CPC ..... A41F 1/002; A44B 1/04; A44D 2203/00
See application file for complete search history.

(56) References Cited

U.S. PATENT DOCUMENTS

| | | | | |
|---|---|---|---|---|
| 5,369,899 | A * | 12/1994 | Reeves | A44C 3/001 24/303 |
| 5,511,289 | A * | 4/1996 | Melia | A44B 6/00 24/459 |
| 9,320,328 | B1 * | 4/2016 | Sinclair | A44C 1/00 |
| 9,489,873 | B2 * | 11/2016 | Sinclair | A44C 1/00 |
| 9,717,293 | B2 * | 8/2017 | Lim | A41F 1/002 |
| 2012/0174346 | A1 * | 7/2012 | Fildan | A41F 1/002 24/303 |
| 2015/0000010 | A1 * | 1/2015 | Boos | A41B 3/08 2/259 |
| 2015/0374108 | A1 * | 12/2015 | Madore | A43B 3/0078 2/209.13 |
| 2016/0206028 | A1 * | 7/2016 | Marks | A41F 1/002 |
| 2018/0303207 | A1 * | 10/2018 | Reiter | A44B 17/0041 |

* cited by examiner

*Primary Examiner* — Robert Sandy
*Assistant Examiner* — David M Upchurch

(57) ABSTRACT

A set of removable flexible polyurethane buttons with magnetic disc inserts that permit two fabrics including garments to become attached and unattached while each button remains secured to the fabric. Assembly includes three parts: a top-hat shaped rare earth magnet partially embedded into a flexible polyurethane disc; a flexible polyurethane button; and a decorative cover. Each of two button disc assemblies can be temporarily attached a fabric by pressing the flat side of the disc against the fabric and securing the flaps of the button over the fabric and disc exposing a magnet face of opposite polarity as the second attached button assembly. The magnets will attract to secure the fabrics together and when pulled apart the button disc assembly remains secured to the fabric. The decorative polyurethane cover can be attached to the face of the button to provide a smooth appearance.

1 Claim, 6 Drawing Sheets

REMOVABLE BUTTON WITH MAGNETIC DISC INSERT ASSEMBLY

CROSS-REFERENCE TO RELATED APPLICATIONS

The present application claims the benefit of provisional patent application Ser. No. 62/710,249, filed Feb. 15, 2018 by the present inventor.

TECHNICAL FIELD

The present invention generally relates to fastening systems, specifically magnetic fasteners for textiles

BACKGROUND PRIOR ART

The following is a tabulation of some prior art that presently appears relevant:

U.S. Patents

| Pat. No. | Kind Code | Issue Date | Patentee |
|---|---|---|---|
| U.S. Pat. No. 9,489,873 | A1 | Nov. 8, 2016 | Sinclair |
| U.S. Pat. No. 9,320,328 | B1 | Apr. 26, 2016 | Sinclair |
| U.S. Pat. No. 9,717,293 | B2 | Aug. 1, 2017 | Lim |
| U.S. Pat. No. 5,369,899 | A4 | Dec. 6, 1994 | Reeves |
| U.S. Pat. No. 5,511,289 | A4 | Apr. 30, 1996 | Melia |

U.S. Patent Application Publications

| Publication Nr. | Kind Code | Publ. Date | Applicant |
|---|---|---|---|
| 20180303207 | A1 | Oct. 25, 2018 | Reiter |
| 20120174346 | A1 | Jul. 12, 2012 | Fildan |
| 20160206028 | A1 | Jul. 21, 2016 | Marks |

Textile fasteners are used for various purposes such as attaching one side of a garment to another and securing ornamentation or decoration to clothing and other fabrics. Rare earth magnets are often used as a component to textile fasteners due to their powerful attraction and ease of use for those with limited dexterity.

Although magnet fasteners are very effective in securing fabrics of varying thicknesses together, they have the following disadvantages:

(a) Some magnetic fasteners do not stay attached to the materials being secured when the magnetic bond is disengaged/pulled apart, thus making it impractical for applications where it is desirable to be able to attach and unattached the materials without concern that the magnetic fastener will disengage from the textile and fall to the floor—such as when opening and closing a sweater or disengaging the connection between top and bottom slimming undergarments in order to use the restroom. U.S. Pat. No. 9,320,328 uses a pegging mechanism and a receiving member in which the pegging member is inserted. This type of magnetic fastener is not securely attached to the textile to allow it to open and close without disengaging from the textile itself.

(b) Some magnetic fasteners require the use of existing buttons on the garment to form the attachment for the magnetic closure mechanism. U.S. Pat. No. 9,717,293 is an assistive retrofit button that utilizes an existing button and thus is not useful in situation where a button does not already exist on the textile.

(c) Some magnetic textile fasteners such as (US patent applications 20180303207, 2012017436 and 20160206028) must be sewn, latched or attached by a permanent or semi-permanent means which is impractical for those who have limited dexterity or skill and inconvenient in situations where only a temporary fastener is desired.

(d) Magnetic textile fasteners that utilize a pegging and receiving member such as a magnetic ball and washer (U.S. Pat. No. 9,717,293) are also difficult to pull apart and can cause inadvertent pinching of skin if not opened or closed with extreme care.

(e) Pegging and receiving member style magnetic textile fasteners can also cause unnecessary stretching of fabric if the fabric is used to break the magnetic bond and disengage the magnets.

(f) Pegging and receiving member style magnetic fasteners, particularly the round ball and washer variety are ideal to applications where a flat appearance is desired such as when used to secure undergarments or other articles under clothing.

(g) some magnetic textile fasteners are comprised of base metals such as nickel that may induce allergic reactions in those with nickel or base metal allergy.

(h) Some magnetic textile fasters are available with decorative covers—for example U.S. Pat. No. 9,489,873 illustrates as decorative cover plate to add a fashion component to an existing magnetic fastener. Such covers rely on the magnetic bond to secure the cover to the fastener. This also creates an inconvenience to the user in as much as the cover does not stay attached to the fabric when the magnet is disengaged. Likewise, magnetic fasteners such as buttons and nameplates (U.S. Pat. No. 5,369,899) are not designed to remain attached to more that one textile or when attached to two textiles with not remain attached to either textile when the magnet is disengaged.

SUMMARY OF THE INVENTION

This invention relates to an apparatus used to temporarily attach a rare earth magnet to a textile or fabric, most notably a garment, by means of sliding the fabric behind a small thin disc that is inserted inside a polyurethane button and held in place by flap projections on the reverse side of the button. Two of these button assemblies, one housing a south polarity magnetic face and the other with a north polarity magnetic face, are used in combination to bring together and hold in place two pieces of fabric by the attraction of the reverse polarity of the opposing magnets.

The embodiments of the button attachment assembly claimed comprises a small circular polyurethane disc with partially embedded magnet, a polyurethane button with four securing flaps, and a thin polyurethane cover with clips.

Accordingly several advantages of one or more aspects are as follows: to provide a decorative button fastening system that can easily be temporarily attached to clothing or other fabrics, to allow these fabrics to be secured or opened at the user's will without being removed from the fabric, that allow for easy attachment and removal without permanently altering or damaging the fabric, that allow the magnetic fastener to be opened and closed with less opportunity to cause soft tissue damage due to pinching of skin between fingers, that are suitable for individuals with base metal allergy, that pose a less significant choking risk. The decorative covers can be produced in various colors and printed or painted designs can be added to the face of the cover. Other embellishments, such as cloth flowers can be affixed to the face of the cover.

Other advantages of one or more aspects will be apparent from a consideration of the drawings and ensuing description

OBJECTS OF THE INVENTION

One object of the present invention to present an improved fastener for fabrics, specifically garments that can be easily placed and removed from garments without puncturing or damaging the material to which it is attached.

Another object of this invention is to provide an improved mechanism of attaching a magnetic closure to a fabric such as a garment that can be opened and closed without removal of the magnet from the fabric.

Another object of this invention is to provide a manner in which a button can be used to attach fabrics of varying thicknesses by use of discs of varying widths to accommodate thick as well as thin fabrics.

Another object of this invention is to provide a manner in which those with limited manual dexterity of the hands can open and close garments with minimal effort and without assistance of others.

DRAWINGS—FIGURES

Figure 1:
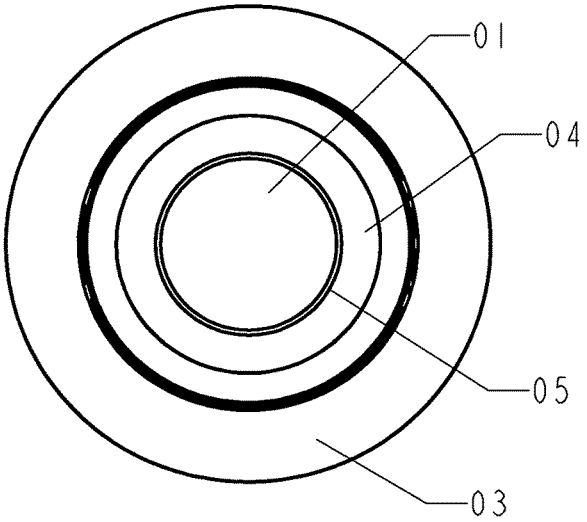
FIG. 1 shows a front view of the disc/magnet assembly
Figure 2:
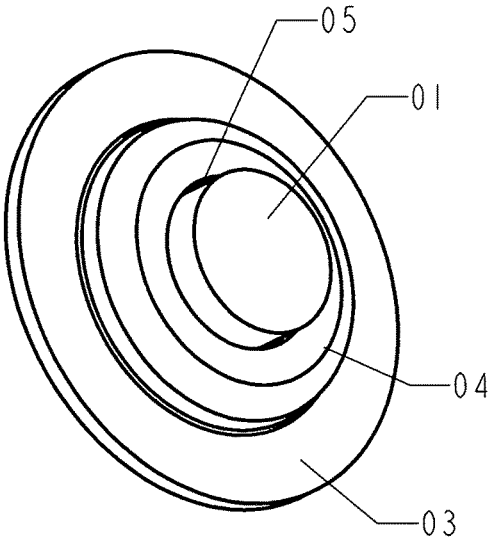
FIG. 2 shows the front side angled view of the disc/magnet assembly
Figure 3:
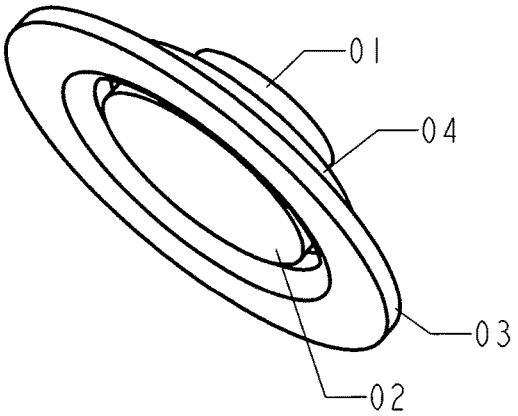

FIG. 3. shows the back side angled view of the disc/magnet assembly

Figure 4:
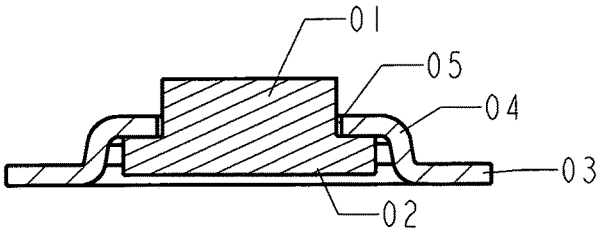

FIG. 4 shows a cut away view of the disc/magnet assembly

Figure 5:
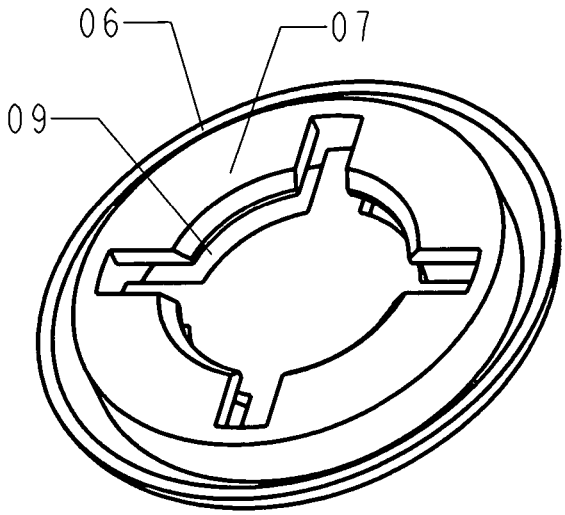

FIG. 5 shows a realistic back view of the polyurethane button

Figure 6:
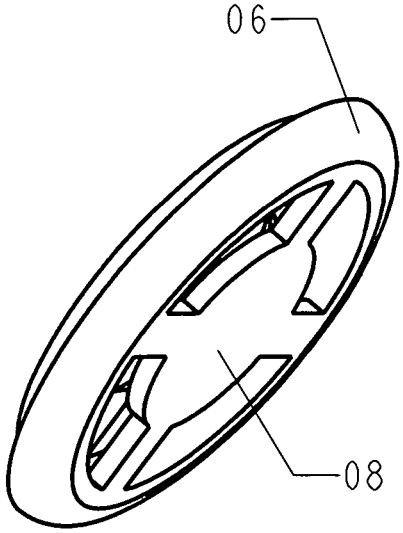

FIG. 6 shows a realistic side view of the polyurethane button

Figure 7:
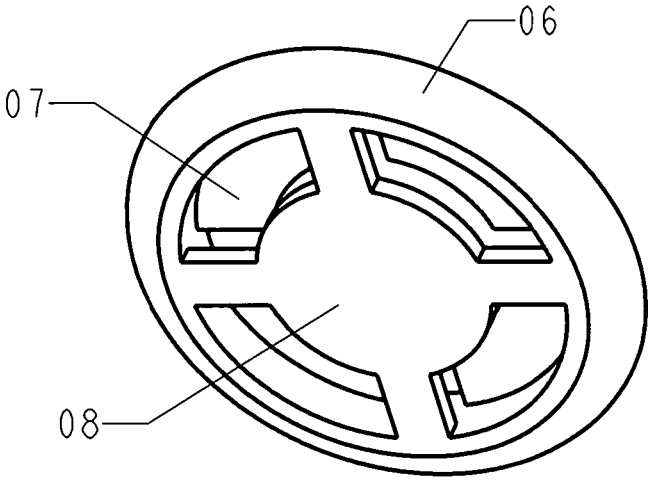

FIG. 7 shows a realistic front view of the polyurethane button

Figure 8:
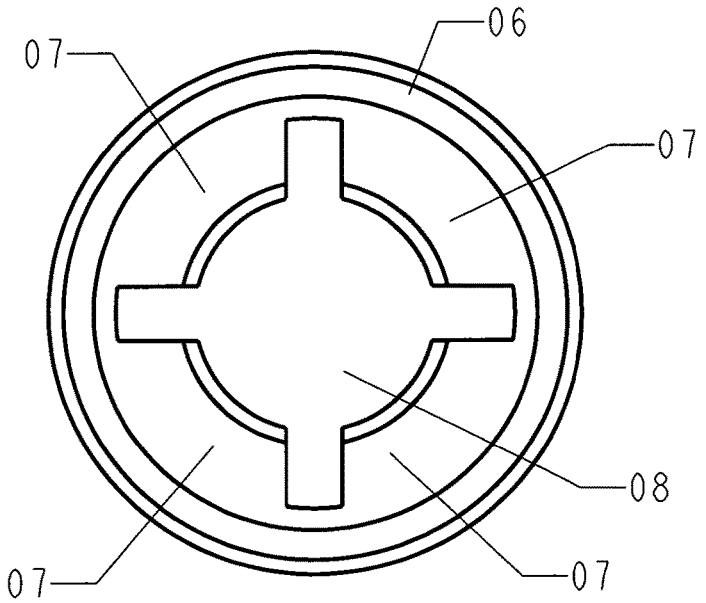

FIG. 8 shows a back of the polyurethane button

Figure 9:
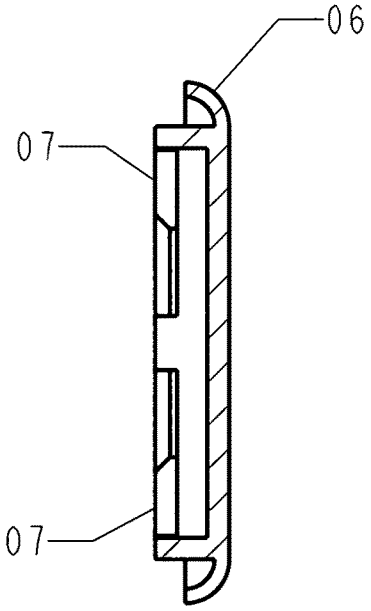

FIG. 9 shows a cutaway view of the polyurethane button

Figure 10:
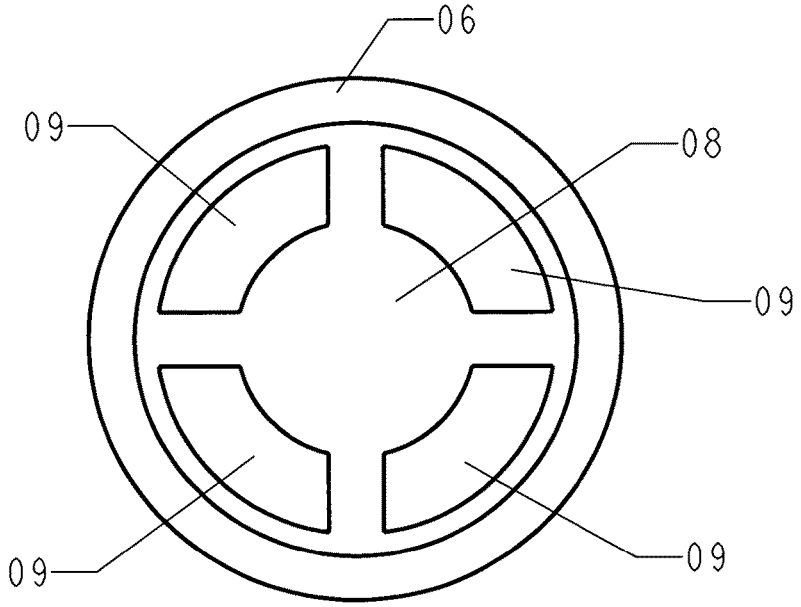

FIG. 10 shows a front view of the polyurethane button

Figure 11:
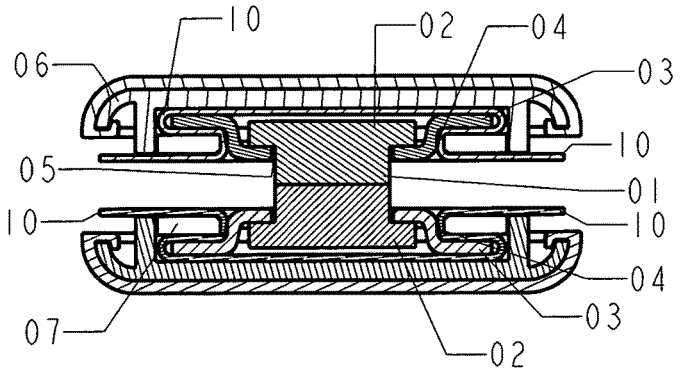

FIG. 11 shows a cutaway view of the polyurethane button in use with fabric

Figure 12:
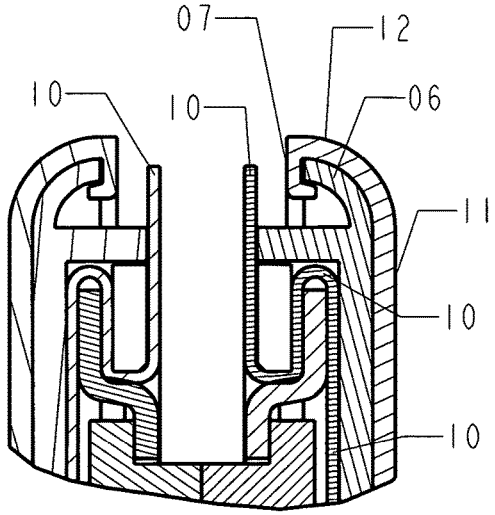
Figure 13:
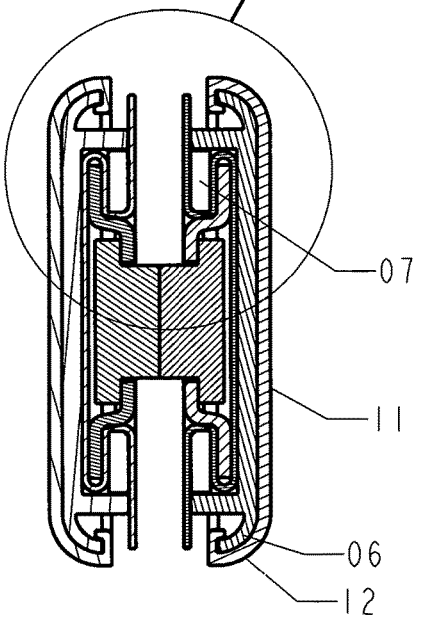
Figure 14:
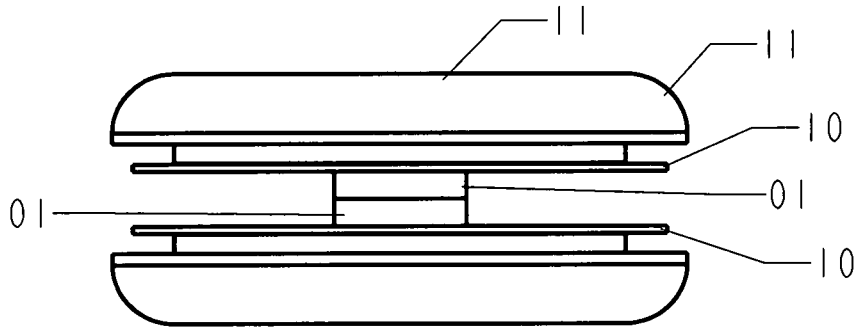
Figure 15:
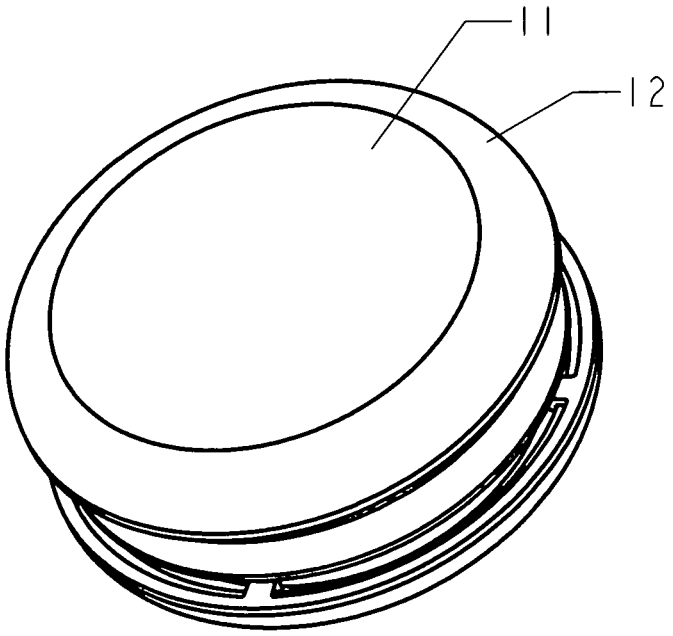
Figure 16:
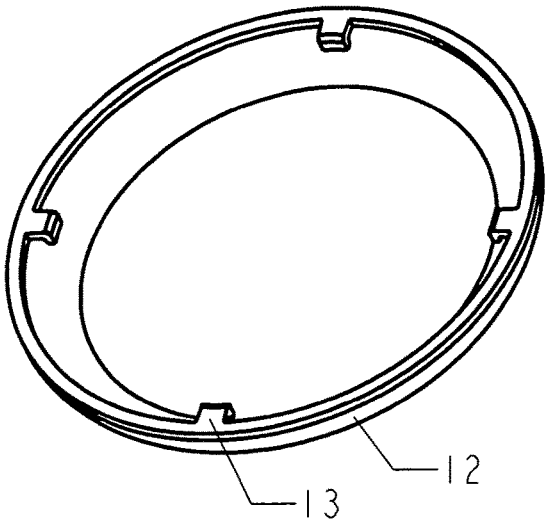
Figure 17:
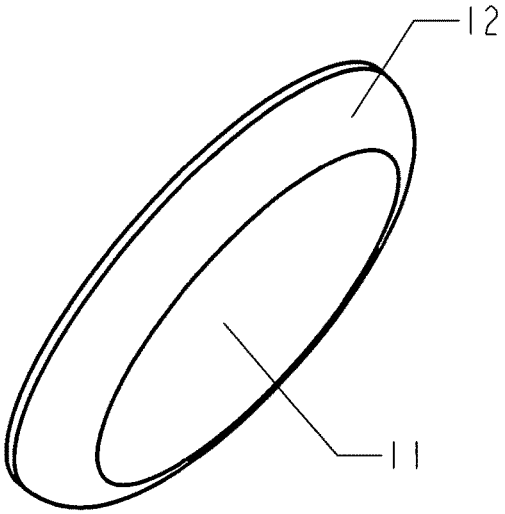
Figure 18:
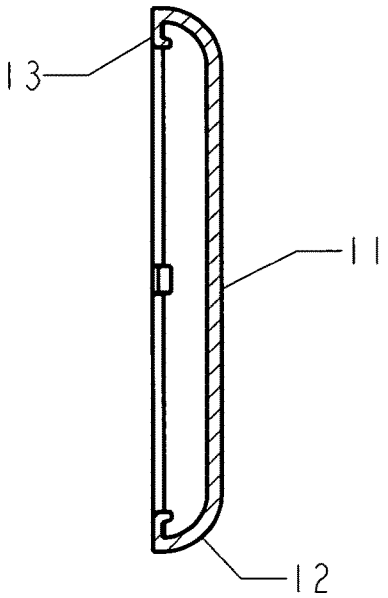

FIG. 12. shows a close-up side cut away view of the polyurethane button in use with fabric FIG. 13 shows a complete side view of the polyurethane button in use with fabric FIG. 14 shows a realistic side view of the polyurethane button in use with fabric FIG. 15 shows a realistic view of polyurethane button assembly with decorative cover FIG. 16 shows the back side of the decorative cover FIG. 17 shows the front side of the decorative button FIG. 18 shows a side cutaway view of the decorative button

DRAWINGS REFERENCE NUMERALS FOR FIG. 1-18

01 represents the small end of the rare earth top hat magnet which may have either north or south polarity.

02 represents the wide end of the rare earth top hat magnet which is embedded in the polyurethane disc.

03 represents the flat base of the round disc.

04 represents the raised step of the round disc under which the wide portion of the top hat magnet is embedded.

05 represents the circular opening in center of the raised step of the round disc through which the magnet protrudes.

06 represents the lip of the polyurethane button that slopes downward away from the front of the button.

07 represents the flexible polyurethane flaps (of which there are 4 on each button).

08 represents the front of the button which consists of a flat circle forms the front of the button and attaches to the side of the button by four bars.

09 represents an access hole on (of which there are four on each button) through which a stick can be inserted to raise the corresponding flap shown in 07 so the disc can be inserted under the flap.

10 represents the fabric or garment that is desired to be attached.

11 represents the face of the decorative button.

12 represents the lip of the decorative button that fits snugly overtop the rim of the lip of the polyurethane button.

13 represents the clip of the decorative cover that secures the decorative cover over the flexible polyurethane button.

DETAILED DESCRIPTION OF THE PREFERRED EMBODIMENTS

A flexible urethane button and disc assembly made of a thin polyurethane step disc with a partially encased top hat shaped magnet (02) which can be placed on one side of a piece of fabric and pressed into the back side of a slightly larger polyurethane button with four flaps. Opposite the four flaps (07) are four corresponding access holes (09) through which a pen or thin stick can be used to raise the flaps (07) over the edge of the disc to secure the fabric between the button and the disc. Once the fabric (10) is secured in the button under the disc the face of the magnet will be exposed on the reverse side of the fabric; a decorative cover that can be used to improve the aesthetics of the button face; two buttons with opposite polarity will attract to hold two pieces of fabric together.

The wide end of a top hat shaped magnet (02) is embedded in flexible urethane disc (less than 0.5 mm thick) of approximately 1 inch in diameter with a flat rim, and which the small end of the top hat magnet (10) protrudes approximately 3 mm from the center of the disc. The button is comprised of a circular polyurethane button with four flaps (07) that are attached to outside rim of the button and extend inward toward the center of the back side of the button approximately one quarter of the diameter of the button. The face of the button opposite each flap (07) has a corresponding access hole (09) the exact dimension of the flap (07) to allow a stick or other thin object to pass through to raise the flap during the insertion of the disc and fabric thereunder. The outer edge of the face of the button extends approximately 2 mm beyond the inside edge of the button curving toward the back of the button—creating a lip or rim (06). The curved lips of the button (06) and cover (12) give the button a smooth appearance under clothing as well as providing a point of attachment for the decorative cover. The decorative round polyurethane cover of approximately the same diameter as the button. The cover fits snugly over the button. The reverse side of the cover contains four equidistant clips (13) that can be slipped over the rim (06) of the button to secure it firmly in place over the button. The cover can be removed by sliding the clips (13) from under the rim (06) of the button. The cover is available in various colors, patterns and designs to change the look of an outfit. The button and cover create a smooth surface when worn under garments. The button assembly is designed to be used in pairs with one assembly containing a magnet of north polarity and the other with a magnet of south polarity. When two assemblies are used together the opposite polarities of the magnets are attracted to each other creating a bond that will hold together various fabrics and can be easily released with mild to moderate force without becoming disengaged from the fabric. The button assembly one can be worn on fabric/garment without puncturing or otherwise permanently altering fabric/garment.

CONCLUSION, RAMIFICATIONS AND SCOPE

Accordingly, the reader will see that the flexible polyurethane button assembly of the various embodiments can be easily attached to fabric of various thicknesses, to conveniently allow the user to secure and separate fabrics from one another with ease. Additionally, the flexible polyurethane button assembly can be removed without damage to the fabric to which it was attached. The assembly has the additional advantages that:

- The button and cover's smooth outer surfaces and thin dimensions make it suitable for wearing under clothing with minimal or no visibility.
- The cover and button are constructed of polyurethane, making it suitable for those with base metal allergy.
- The decorative cover remains in place until intentionally removed by the wearer.

Although the description above contains many specificities, these should not be construed as limiting the scope of the embodiments, but as merely providing illustrations of some of the several embodiments.

The invention claimed is:

1. A magnetic fabric fastening apparatus comprising:

a button of circular shape, fabricated from polyurethane or other flexible plastic, having a frontside and a backside, the frontside having a central circle to which four flat bands extend outwardly in a linear plane from the circumference and perpendicular to one another forming the shape of a cross, of which the distal end of each band is connected to the inner circumference of another circle which forms an outer rim around the button, of which the outer rim slants in a convex curve away from the frontside of the button and toward the backside of the button, and the area contained between any two bars and the outer rim and the inner circle being open to the backside of the button and a backside which consists of a ledge formed perpendicular to and around the circumference of the underside of the button, and from which four flexible flaps are connected and extend inwardly at an angle that is parallel to the front side of the button and of which each of the four flaps is adjacent to each of the four openings located on the frontside of the button, a magnet fabricated of rare earth minerals having the shape of a cylinder of a smaller diameter stacked on top and connected to a second cylinder of a larger diameter, of which the larger diameter cylinder is encased in polyurethane or other flexible plastic and of which the underside of the larger diameter cylinder is covered with flexible polyurethane or other flexible plastic, and which the polyurethane or other flexible plastic on the underside of the larger diameter cylinder extends out beyond the circumference of the larger diameter cylinder by a several millimeters forming the shape of a disc, of which the disc is no thicker than one quarter the thickness of the larger diameter cylinder, a cover of circular shape, fabricated of polyurethane or other flexible plastic which consists of a frontside and a backside, of which the front side is flat centrally and extends outwardly to a convex outer rim and a backside which is flat centrally and extends outwardly to a concave outer rim and the outermost edge of the rim having four approximately equally spaced projections attached and extending centrally.

* * * * *